US009822424B2

(12) United States Patent
Ishii et al.

(10) Patent No.: US 9,822,424 B2
(45) Date of Patent: Nov. 21, 2017

(54) HIGH RATE MAGNETIC ANNEALING SYSTEM AND METHOD OF OPERATING

(71) Applicant: Tokyo Electron Limited, Minato-ku, Tokyo (JP)

(72) Inventors: Toru Ishii, Dublin (IE); Mitsuru Yamazaki, Tokyo (JP)

(73) Assignee: TOKYO ELECTRON LIMITED, Tokyo (JP)

( * ) Notice: Subject to any disclaimer, the term of this patent is extended or adjusted under 35 U.S.C. 154(b) by 188 days.

(21) Appl. No.: 14/752,271

(22) Filed: Jun. 26, 2015

(65) Prior Publication Data

US 2016/0177412 A1 Jun. 23, 2016

Related U.S. Application Data

(60) Provisional application No. 62/093,081, filed on Dec. 17, 2014.

(51) Int. Cl.

| | |
|---|---|
| ***C21D 9/00*** | (2006.01) |
| ***C21D 1/26*** | (2006.01) |
| ***H01F 41/30*** | (2006.01) |

(52) U.S. Cl.

CPC ..... *C21D 9/0006* (2013.01); *C21D 1/26* (2013.01); *C21D 9/00* (2013.01); *H01F 41/304* (2013.01)

(58) Field of Classification Search

CPC ..... F27B 5/14
USPC ..... 148/108
See application file for complete search history.

(56) References Cited

U.S. PATENT DOCUMENTS

| | | | | |
|---|---|---|---|---|
| 6,455,815 | B1 * | 9/2002 | Melgaard | F27B 5/14 148/108 |
| 2002/0001460 | A1 | 1/2002 | Seko et al. | |
| 2002/0182557 | A1 * | 12/2002 | Kuriyama | C21D 1/04 432/124 |
| 2004/0263303 | A1 | 12/2004 | Kuriyama et al. | |

* cited by examiner

*Primary Examiner* — Scott Kastler
(74) *Attorney, Agent, or Firm* — Rothwell, Figg, Ernst & Manbeck, P.C.

(57) ABSTRACT

An annealing system and method of operating is described. The annealing system includes a furnace having a vacuum chamber wall that defines a processing space into which a plurality of workpieces may be translated and subjected to thermal and magnetic processing, wherein the furnace further includes a heating element assembly having at least one heating element located radially inward from the vacuum chamber wall and immersed within an outer region of the processing space, and wherein the heating element is composed of a non-metallic, anti-magnetic material. The annealing system further includes a magnet system arranged outside the vacuum chamber wall of the furnace, and configured to generate a magnetic field within the processing space.

20 Claims, 7 Drawing Sheets

HIGH RATE MAGNETIC ANNEALING SYSTEM AND METHOD OF OPERATING

CROSS-REFERENCE TO RELATED APPLICATIONS

Pursuant to 37 C.F.R. §1.78(a)(4), this application claims the benefit of and priority to U.S. Provisional Application No. 62/093,081 filed on Dec. 17, 2014, which is expressly incorporated by reference herein in its entirety.

FIELD OF INVENTION

The invention relates to an annealing system and method for processing a microelectronic workpiece, and in particular, a system and method for annealing one or more layers containing magnetic material on a microelectronic workpiece.

BACKGROUND OF THE INVENTION

Description of Related Art

Magnetic annealing is one of three processes required to manufacture magnetoresistive random access memory (MRAM) devices compatible with conventional complementary metal oxide semiconductor (CMOS) logic based microelectronic workpieces. To successfully anneal a workpiece, the ferromagnetic layer must be held at a predetermined temperature in a magnetic field for a period of time long enough for the crystals to orient themselves in a common direction upon cooling. This process, which is also referred to as "soak" is carried out in an inert, reducing, or vacuum environment to prevent oxidation of the workpieces, while they are held at the predetermined temperature.

Magnetic annealing equipment generally operates in batch-mode, i.e., plural workpieces are annealed at the same time, and performs a sequence of steps. As an example, these steps include heating, soaking, and cooling the workpieces in the presence of a magnetic field, typically between 0.02 and 7 T (Tesla). The cost of MRAM device manufacturing is linked to the magnetic annealing tools, where the productivity (acceptable devices produced per hour) is the product of density (number of devices per workpiece), throughput (workpieces per hour), and yield (ratio of acceptable devices to total number of devices processed), as dictated by the overall thermal/anneal cycle.

Conventionally, magnetic annealing systems have long temperature ramp-up and ramp-down cycle times, thus leading to reduced throughput. And, with manufacturing facility floor-space being a premium, workpiece throughput is critical for successful implementation.

SUMMARY OF THE INVENTION

Embodiments of the invention relate to an annealing system and method for processing a microelectronic workpiece, and in particular, a system and method for annealing one or more layers containing magnetic material on a microelectronic workpiece.

According to one embodiment, an annealing system is described. The annealing system includes a furnace having a vacuum chamber wall that defines a processing space into which a plurality of workpieces may be translated and subjected to thermal and magnetic processing, wherein the furnace further includes a heating element assembly having at least one heating element located radially inward from the vacuum chamber wall and immersed within an outer region of the processing space, and wherein the heating element is composed of a non-metallic, anti-magnetic material. The annealing system further includes a magnet system arranged outside the vacuum chamber wall of the furnace, and configured to generate a magnetic field within the processing space.

According to another embodiment, a method for operating an annealing system is described. The method includes: loading a plurality of workpieces into a first workpiece boat; translating the first workpiece boat into a processing space of a furnace using a boat loader, the furnace having a heating element assembly including at least one heating element surrounding the first workpiece boat, wherein the heating element is composed of a non-metallic, anti-magnetic material; elevating a temperature of the plurality of workpieces by coupling power to the heating element assembly; and generating a magnetic field within the processing space using a magnet system arranged outside the furnace.

DETAILED DESCRIPTION OF SEVERAL EMBODIMENTS

Systems and methods for annealing a microelectronic workpiece are described in various embodiments. One skilled in the relevant art will recognize that the various embodiments may be practiced without one or more of the specific details, or with other replacement and/or additional methods, materials, or components. In other instances, well-known structures, materials, or operations are not shown or described in detail to avoid obscuring aspects of various embodiments of the invention. Similarly, for purposes of explanation, specific numbers, materials, and configurations are set forth in order to provide a thorough understanding of the invention. Nevertheless, the invention may be practiced without specific details. Furthermore, it is understood that the various embodiments shown in the figures are illustrative representations and are not necessarily drawn to scale.

Reference throughout this specification to "one embodiment" or "an embodiment" means that a particular feature, structure, material, or characteristic described in connection with the embodiment is included in at least one embodiment of the invention, but do not denote that they are present in every embodiment. Thus, the appearances of the phrases "in one embodiment" or "in an embodiment" in various places throughout this specification are not necessarily referring to the same embodiment of the invention. Furthermore, the particular features, structures, materials, or characteristics may be combined in any suitable manner in one or more embodiments. Various additional layers and/or structures may be included and/or described features may be omitted in other embodiments.

"Microelectronic workpiece" as used herein generically refers to the object being processed in accordance with the invention. The microelectronic workpiece may include any material portion or structure of a device, particularly a semiconductor or other electronics device, and may, for example, be a base substrate structure, such as a semiconductor substrate or a layer on or overlying a base substrate structure such as a thin film. Thus, workpiece is not intended to be limited to any particular base structure, underlying layer or overlying layer, patterned or unpatterned, but rather, is contemplated to include any such layer or base structure, and any combination of layers and/or base structures. The description below may reference particular types of substrates, but this is for illustrative purposes only and not limitation.

As briefly described above, manufacturing facility floorspace is a premium, and thus, tool footprint and workpiece throughput are critical for successful implementation. The annealing system described below is the first of its kind in the magnetic annealing market that can heat and cool a plurality of workpieces at sufficiently high heating and cooling rates to achieve acceptable workpiece throughput for production.

Figure 1A:
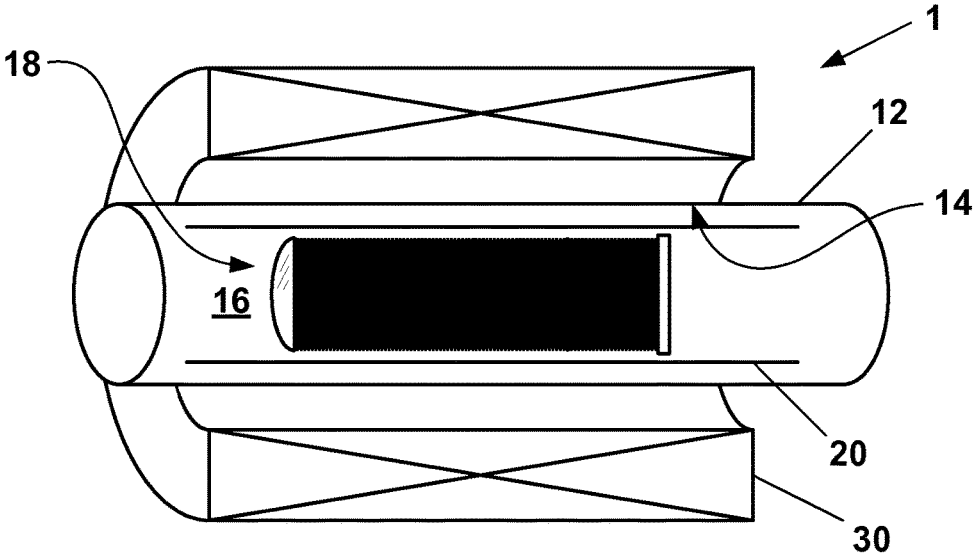
FIGS. 1A and 1B provide schematic illustrations of annealing systems according to embodiments.
Figure 1B:
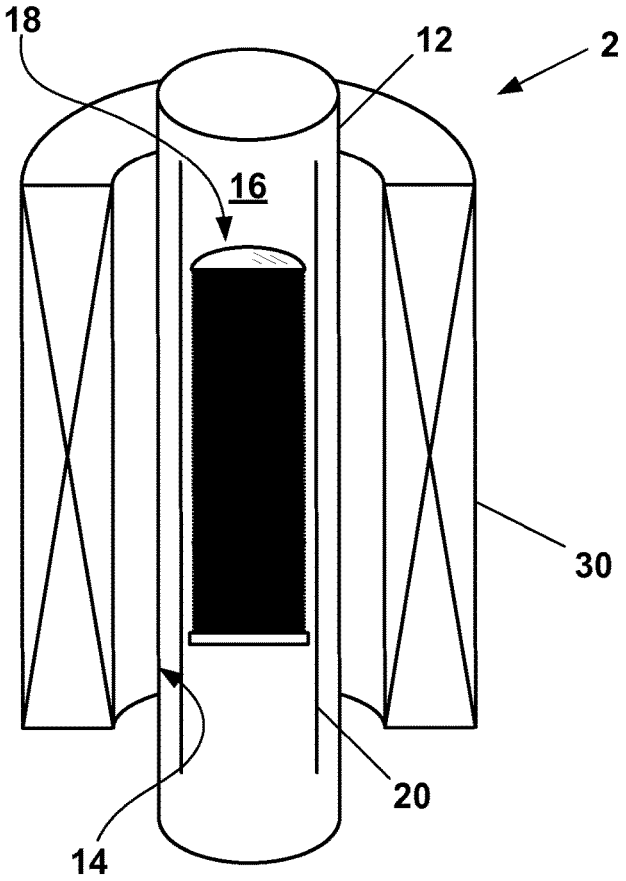

Therefore, referring now to the drawings, wherein like reference numerals designate identical or corresponding parts throughout the several views, FIGS. 1A and 1B provide schematic illustrations of annealing systems according to various embodiments. As shown in FIG. 1A, an annealing system 1 is depicted. The annealing system 1 includes a furnace 12 having a vacuum chamber wall 14 that defines a processing space 16 into which a plurality of workpieces 18 may be translated and subjected to thermal and magnetic processing. The furnace 12 further includes a heating element assembly 20 located radially inward from the vacuum chamber wall 14 and immersed within an outer region of the processing space 16. The heating element assembly 20 includes one or more heating elements composed of a non-metallic, anti-magnetic material. Annealing system 1 further includes a magnet system 30 arranged outside the vacuum chamber wall 14 of the furnace 12, and configured to generate a magnetic field within the processing space 16.

As shown in FIG. 1A, annealing system 1 is depicted in a horizontal configuration for both in-plane and out-of-plane treatment of the plurality of workpieces 18. In an alternate embodiment, as shown in FIG. 1B, an annealing system 2 is depicted in a vertical configuration for both in-plane and out-of-plane treatment of the plurality of workpieces 18.

In one embodiment, heating element assembly 20 includes at least one heating element composed primarily of carbon (C). A carbon heating element is selected for several reasons including, but not limited to: (i) the element is non-metallic and is composed of an anti-magnetization material, which is suitable for use in the presence of a magnetic field; (ii) the element can be fabricated in various shapes, including curved sections for implementation in a cylindrical furnace and sectioned for zone controllability; (iii) the element is controlled by DC (direct current) power; (iv) the element is composed of a reliable material that has longevity for use in semiconductor applications; and (v) the element is composed of a material that is compatible, i.e., cleanliness or low contamination, with semiconductor nanograde applications.

In another embodiment, the heating element is sheathed within a protective casing. The protective casing can be composed of a material that is substantially transparent to the radiant energy of the heating element and that is materially compatible with the magnetic annealing processes being performed in annealing system 1, 2. For example, the protective casing can be at least partially transparent to wavelengths in the electromagnetic spectrum ranging from of 0.78 to 1000 microns (e.g., infrared spectrum). Additionally, for example, the protective casing may include quartz or sapphire.

Furthermore, in yet another embodiment, vacuum chamber wall 14 can be fabricated to produce a highly reflective surface and enhance radiative heating of the plurality of workpieces 18. For example, the vacuum chamber wall 14 can be fabricated with at least a portion of the inner surface having a reflectance equal to or greater than 50%. Alternatively, for example, the vacuum chamber wall 14 can be fabricated with at least a portion of the inner surface having a reflectance equal to or greater than 60%. Alternatively yet, for example, the vacuum chamber wall 14 can be fabricated with at least a portion of the inner surface having a reflectance equal to or greater than 70%.

The fabrication process can include polishing at least a portion of the inner surface of the vacuum chamber wall 14. The degree of polishing can be characterized by a surface roughness, such as a maximum roughness ($R_{max}$), an average roughness ($R_a$), or a root-mean-square (rms) roughness ($R_q$). For example, the maximum roughness ($R_{max}$) for a polished finish can be less than approximately 25 microns. Alternately, the maximum roughness can be less than approximately 5 microns. Alternately, the maximum roughness can be less than approximately 2 microns. Alternatively, the maximum roughness can be less than approximately 1 micron. Alternatively yet, the maximum roughness can be less than approximately 0.5 micron. Alternatively yet, the maximum roughness can be less than approximately 0.1 micron. A mirror-finish can be achieved with a metal surface, such as a stainless steel surface, using a mechanical, chemical, and/or electrical polishing process. For example, the vacuum chamber wall 14 can be composed of stainless steel, and at least a portion of an inner surface of the vacuum chamber wall 14 is polished to an average roughness ($R_a$) of less than 0.5 micron, preferably less than 0.1 micron, or more preferably less than 0.05 micron. In order to maintain the surface condition, e.g., reflectance and degree of polish, the inner surface of the vacuum chamber wall 14 is periodically treated to refinish or remove residue. For example, the surface may be periodically wiped clean of residue.

Figure 2:
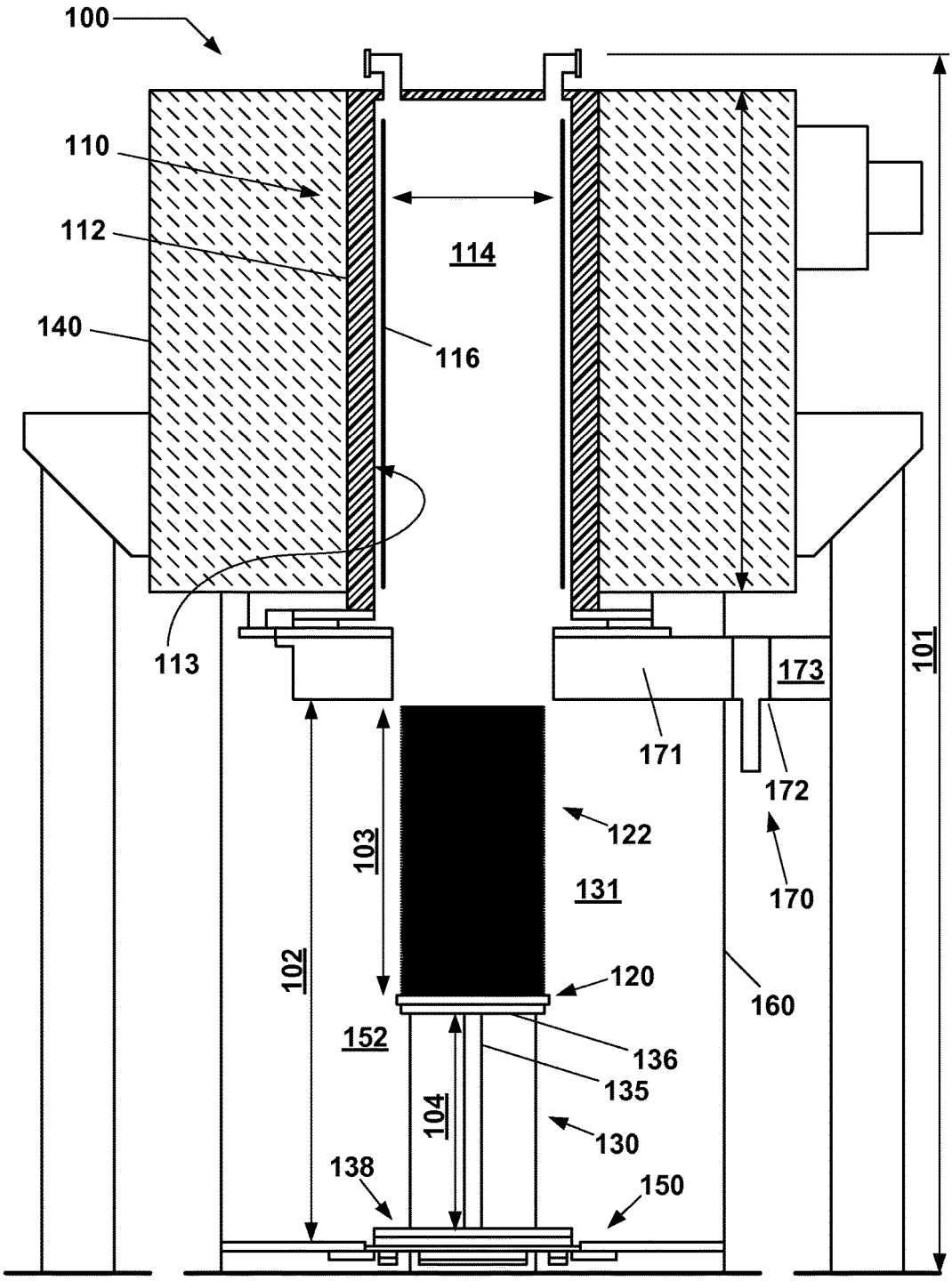
FIG. 2 is a detailed illustration of a side view of an annealing system according to an embodiment.
Figure 3:
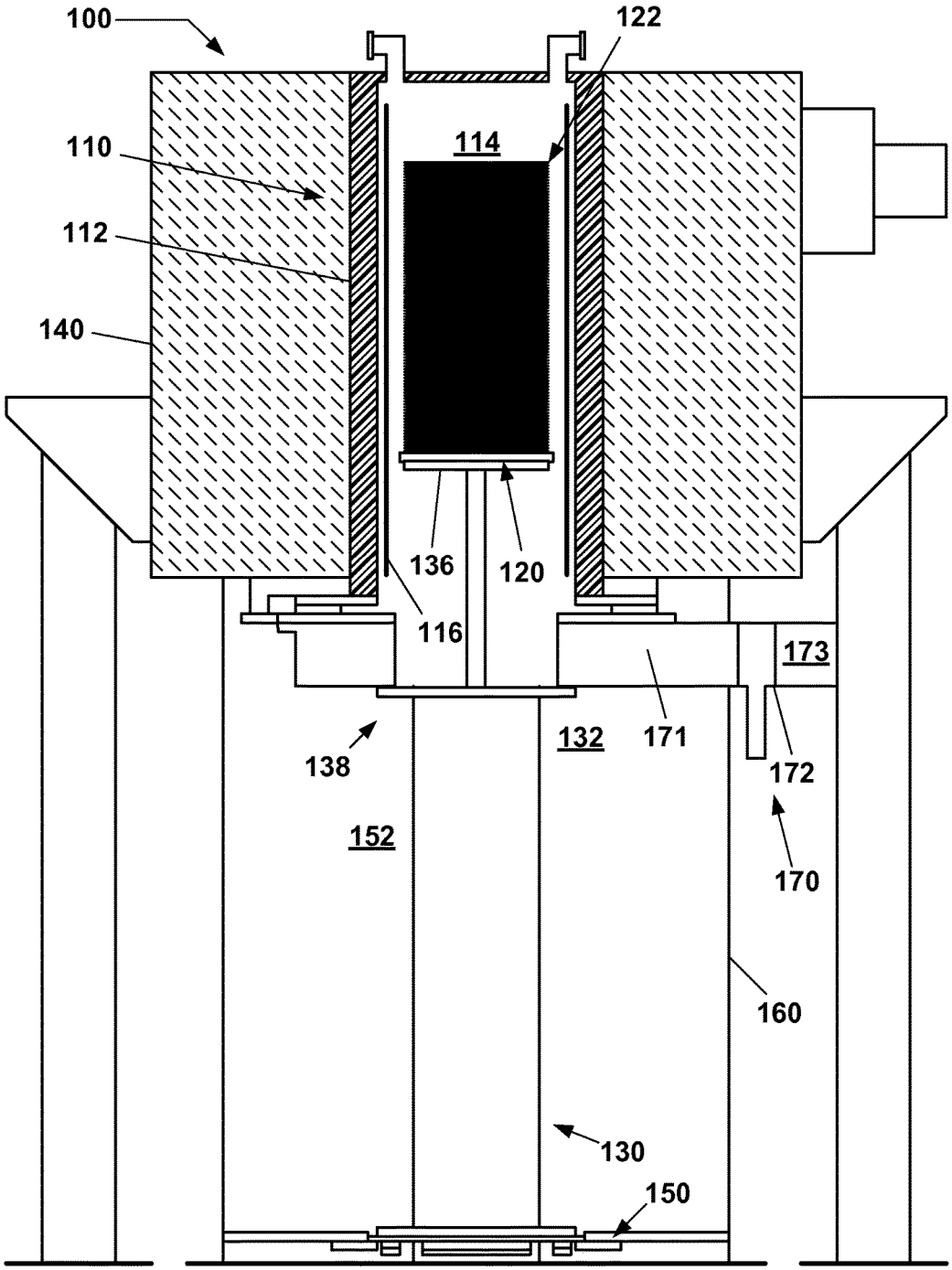
FIG. 3 is another detailed illustration of the annealing system depicted in FIG. 2.

FIGS. 2 and 3 illustrate an annealing system for annealing a plurality of workpieces according to an embodiment. Annealing system 100 includes a vertical furnace 110 having a vacuum chamber wall 112 and heating element assembly 116 located radially inward from the vacuum chamber wall 112 and immersed within an outer region of a processing space 114 into which a plurality of workpieces 122 may be vertically translated and subjected to thermal and/or magnetic processing.

As illustrated in FIGS. 2 and 3, the heating element assembly 116 is immersed within processing space 116 such that the heating element assembly 116 is exposed to vacuum. The heating element assembly 116 includes one or more heating elements composed of a non-metallic, anti-magnetic material. For example, the heating element can be composed primarily of carbon (C). Additionally, for example, the carbon heating element is commercially available from Covalent Materials Corporation. In another embodiment, the heating element assembly 116 is sheathed within a protective casing. The protective casing can be composed of a material that is substantially transparent to the radiant energy of the heating element assembly 116 and material-friendly to the magnetic annealing processes being performed in annealing system 100. For example, the protective casing may include quartz or sapphire.

It will be understood by those skilled in the art that the workpieces can be semiconductor substrates, wafers, MRAM devices/chips, giant magneto resistance (GMR) heads, hard disc drives, and any other device which may be annealed at an elevated temperature with or without a magnetic field present. Workpieces may include, for example, semiconductor wafers used in the manufacture of MRAM devices, wafers used in the manufacture of MTJ devices, GMR sensors, magnetization of metallic objects at elevated temperatures, degaussing of magnetic thin films, and other objects that require annealing under the influence of magnetic fields.

The annealing system 100 further includes a workpiece boat 120 for carrying plural workpieces 122, and a boat loader 130 arranged beneath the vertical furnace 110, and configured to vertically translate the workpiece boat 120 and position the workpieces 122 within the processing space 114. The workpieces 122 may be arranged in a horizontal orientation for closely spacing the workpieces 122 in processing space 114. In this orientation, for example, out-of-plane (e.g., perpendicular) magnetic annealing may be performed. The workpieces 122, which may include semiconductor workpieces, may be placed at a non-variable or variable pitch of about 2 mm to about 10 mm, when wafers are processed, in order to effectively perform the thermal cycle. For example, the plurality of workpieces may be arranged within the workpiece boat 120 at a pitch equal to or less than 6.5 mm. As yet another example, the pitch may range from 4 mm to 4.5 mm.

Figure 4:
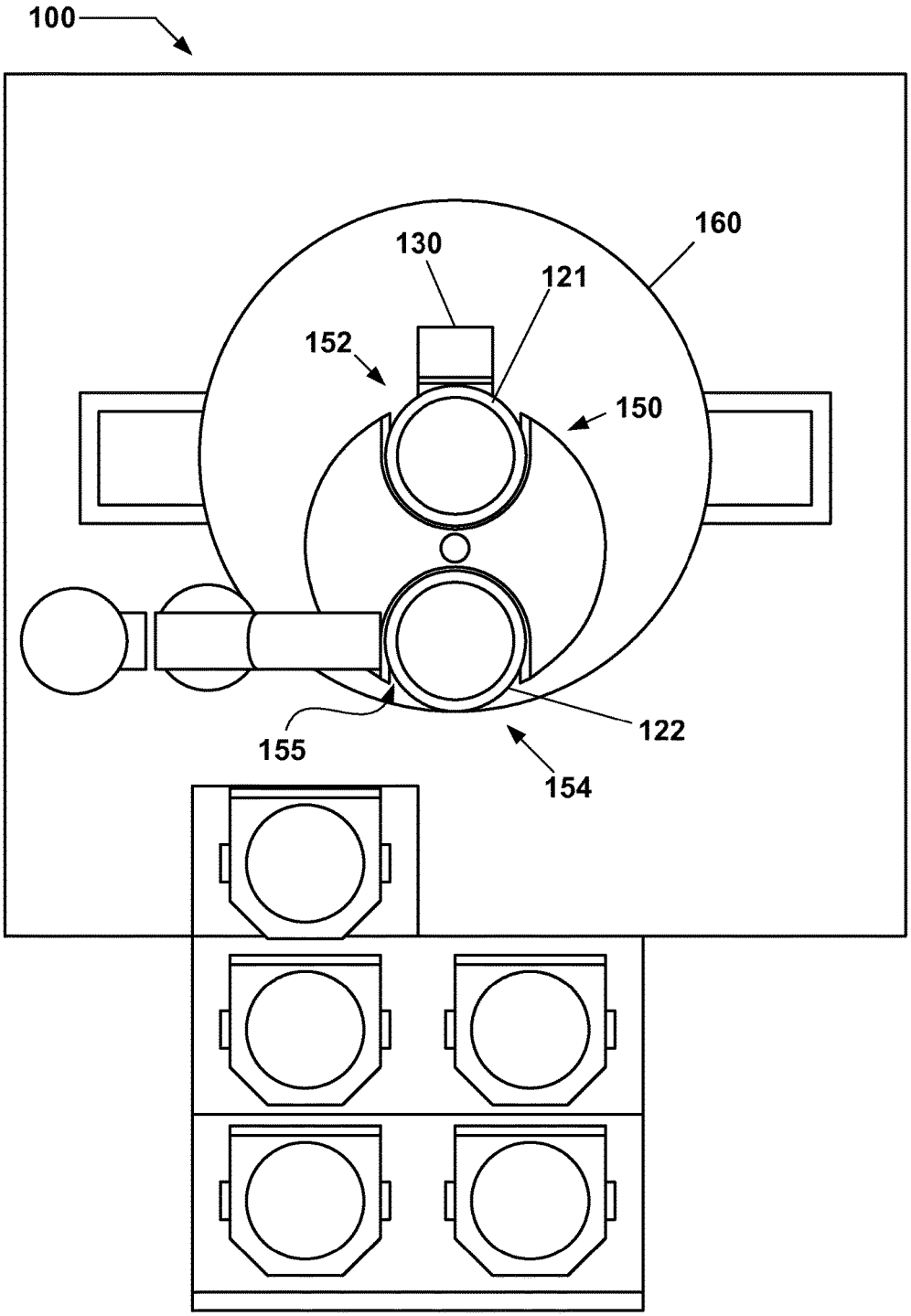
FIG. 4 is a detailed illustration of a top view of the annealing system depicted in FIG. 2.

Furthermore, as shown in FIGS. 2, 3, and 4, the annealing system 100 includes a workpiece boat transport system 150 arranged beneath the vertical furnace 110, and configured to support at least two workpiece boats 121, 122 and index the at least two workpiece boats 121, 122 between a process position 152 and a load/unload position 154. The workpiece boat transport system 150 has an opening 155 to permit the boat loader 130 to engage and vertically translate the workpiece boat 120 into and out of the vertical furnace 110. The boat loader 130 and workpiece boat transport system 150 may be housed within an enclosure 160 to facilitate a reduced contamination environment.

The boat loader 130 is positioned in the process position 152, yet at a first elevation 131 beneath the vertical furnace 110. In FIG. 2, boat loader 130 is positioned in the process position 152, yet at a second elevation 132, wherein the boat 120 and workpieces 122 are placed within the vertical furnace 110. To achieve vertical elevation changes, the boat loader 130 includes a loading arm 135 oriented vertically and characterized by a length 104 ($L_a$) that is sufficiently long to locate the workpiece boat 120 within the bore of the magnet system 140 and the vertical furnace 110. The length $L_a$ of the loading arm 135 may range up to about 1 m. The boat loader 130 further includes a platform 136 located at a distal end of the loading arm 135, and configured to engage and support the workpiece boat 120 when loading and unloading the workpiece boat 120 to and from the vertical furnace 110, and a drive system 138 located at an opposing distal end of the loading arm 135, and configured to vertically translate the workpiece boat 120.

As shown in FIG. 2, the annealing system 100 can have a total height 101 less than or equal to 3.500 m. To do so, for example, the height 102 of the enclosure 160 underneath the vertical furnace 110 (from the bottom of the vertical furnace 110 to the workpiece boat transport system 150) is less than or equal to 1.400 m, and the height 103 of the workpiece stack is less than or equal to 0.460 m.

In order to further reduce the height 102 of the enclosure 160 underneath the vertical furnace 110 (from the bottom of the vertical furnace 110 to the workpiece boat transport system 150), the boat loader 130 can include a retractable loading arm that may be characterized by a retracted length ($L_{a,r}$) and an extended length ($L_{a,e}$), the latter being sufficiently long to locate a workpiece boat 120 with workpieces 122 within the bore of the magnet system 140 and the vertical furnace 110. The extended length $L_{a,e}$ of the retractable loading arm may range up to about 1 m (i.e., approximately the same as the non-retractable loading arm), and the retracted length $L_{a,r}$ of the retractable loading arm may range up to about 0.6 m. In designing the loading arm to be retractable and extendable, the space required underneath the vertical furnace can be reduced, and the vertical distance to be translated by the boat loader is also reduced. To impart the retraction and extension movement of the retractable loading arm, an actuating mechanism is used, wherein the actuating mechanism may include any electrical, mechanical, electromechanical, hydraulic, or pneumatic device.

In the second elevation 132, the vertical furnace 110 may be sealed and evacuated to a reduced pressure relative to ambient pressure using pumping system 170. A process gas may or may not be introduced to the vertical furnace 110 at a predetermined flow rate from a gas source (not shown). As shown in FIGS. 2 and 3, vertical furnace 110 is connected via evacuation line 171 to pumping system 170 for evacuating the process chamber and creating vacuum therein. The pumping system may include a vacuum pump 173 and valve 172, which in tandem permits controllably drawing a vacuum in the range of $10^{-8}$ to 100 Torr. In an exemplary embodiment, the vacuum pump 173 may include a roughing pump and/or a high vacuum pump. The roughing pump is employed to draw a vacuum to about $10^{-3}$ Torr, while the high vacuum pump is subsequently employed to further reduce the vacuum pressure to $10^{-7}$ Torr or lower. The roughing pump can be selected from among an oil sealed pump or dry pump, while the high or hard vacuum pump can be selected from among, turbomolecular pumps, diffusion pumps, cryo-pumps, or any other device capable of drawing the requisite vacuum.

Furthermore, the annealing system 100 includes a temperature control system (not shown) coupled to the heating element assembly 116 and configured to controllably adjust the temperature of the workpieces 122 to a predetermined value or sequence of values of temperature. The temperature control system may include one or more arrays of heating elements arranged around or adjacent to the vertical furnace 110 (e.g., arranged to surround the vertical furnace 110), and configured to heat and cool the workpieces 122 according to an anneal temperature recipe. For example, the one or more arrays of heating elements may include one or more resistive heating elements, one or more heated or cooled fluid conduits or jackets, one or more radiation sources (e.g., infrared (IR) source/lamp, ultraviolet (UV) source/lamp, etc.), etc.

Further yet, the annealing system 100 includes a magnet system 140 arranged outside the vertical furnace 110, and configured to generate a magnetic field within the processing space 114. The magnetic field may be designed to possess a predetermined magnetic field strength and orientation within the interior of the vertical furnace 110. The magnet system 140 may include one or more magnets arranged in a solenoidal or Helmholtz configuration around or adjacent the vertical furnace 110. For example, the magnet system 140 may include a superconducting magnet, an electromagnet, or a permanent magnet, or a combination of two or more thereof. The magnet system 140 can be configured to generate a magnetic field ranging from about 0.02 to 10 T (Tesla) within the vertical furnace 110.

While not shown, the annealing system 100 may also include a controller coupled to the temperature control system, the magnet system 140, and the pumping system 170, and configured to send and receive programmable instructions and data to and from the components of the annealing system 100. For example, the controller may be programmed to control the anneal temperature of the workpieces, the anneal time period, the magnetic field strength, the pressure in the vertical furnace 110, the process gas flow rate (if any) delivered to the vertical furnace 110, and the temporal and/or spatial variation of any of these process parameters.

Figure 5:
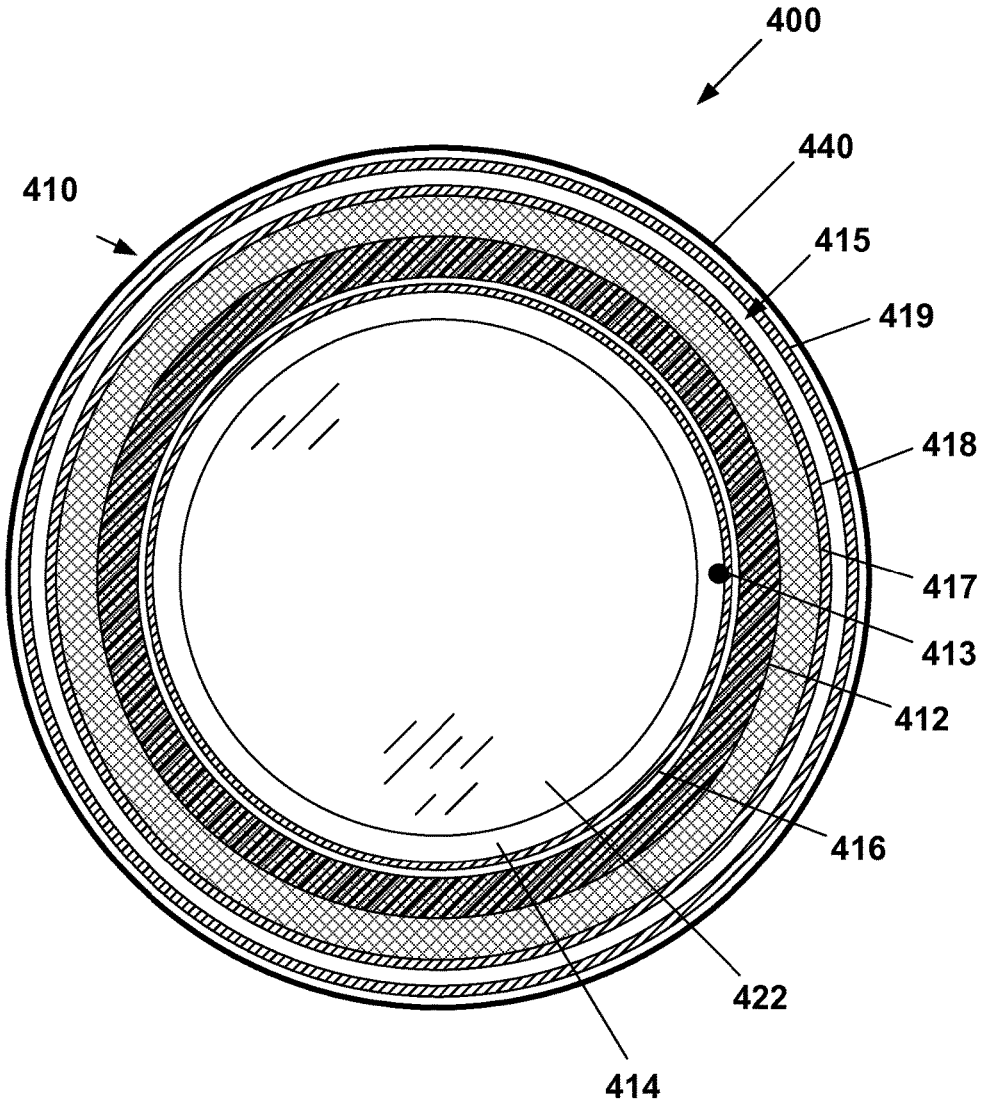
FIG. 5 provides a cross-sectional view of at least part of an annealing system according to an embodiment.

Referring now to FIG. 5, a cross-sectional view of at least part of an annealing system 400 is provided according to an embodiment. More specifically, this partial cross-section details the structure of vertical furnace 110 beginning with the inner wall 440 of the magnet bore outside vertical furnace 410 and proceeding radially inward to the processing space 414 within which workpieces 422 are treated.

Surrounding processing space 414 is a vacuum chamber wall 412. Vacuum chamber wall 412 surrounds the workpieces 422, and forms a vacuum barrier for processing space 414 within which a heating element assembly 416 is immersed. Furthermore, the vacuum chamber wall 412 may be composed of any type of material suitable for use in a semiconductor fab, such as stainless steel. As described above, the vacuum chamber wall 412 can include a polished inner surface.

The heating element assembly 416 includes one or more heating elements, such as resistive heating elements. Preferably, the heating elements are selected from an array of electrical resistance heaters sufficient to provide and maintain an anneal temperature. As utilized herein, annealing temperatures range from about 200-1000 degrees C., depending on the device being manufactured. As described above, the heating elements are composed of a non-metallic, anti-magnetic material with relatively high radiant heat efficiency. For example, the heating elements can be composed primarily of carbon (C) and sheathed within a protective casing.

Furthermore, the heating element assembly 416 may include one or more heating assembly zones that can be independently monitored and controlled using, for example, one or more sensors 413 and a controller. For example, spatially controlled, or uniform, heating of the workpieces 422 can be accomplished by independently providing energy and control of the various heater elements in the heating element assembly 416. In one embodiment, the heater elements are divided axially into three different zones, wherein the center zone heater is aligned with the workpiece stack. And, two end zone heaters are provided above and below the center heater, respectively, and are independently controlled. Alternatively, the center zone heater may be divided into two independently controlled central heating zones.

In another embodiment, the heaters can be divided azimuthally into separate zones, for instance, three heaters each covering 120 degrees. The power input to each heated zone can be varied separately to achieve uniform heating. Generally, the thermal mass of the heater elements and protective casing should be minimized to reduce the power input for a given temperature rise, and heat removal for a given temperature drop. In other words, it is desirable for the workpieces 422 to be the largest thermal mass in the system. In this manner, the possibility of temperature non-uniformity is greatly reduced.

Further yet, the controller can programmably operate a power supply to achieve workpiece heating rates ranging from about 10° C. per minute to about 200° C. per minute, or about 10° C. per minute to about 100° C. per minute, or about 15° C. per minute to about 100° C. per minute, or about 20° C. per minute to about 100° C. per minute, or about 25° C. per minute to about 100° C. per minute. Typical heating element configurations/compositions, e.g., NiCr, FeCrAl, and other metal alloys, generate heating rates less than 10° C. per minute. Furthermore, the controller can controllably operate the power supply to achieve workpiece cooling rates ranging from about 5° C. per minute to about 20° C. per minute. As an example, a workpiece heating rate of 100° C. per minute can be achieved when processing fifty (50) 300 mm workpieces.

Surrounding the vacuum chamber wall 412 can be an insulation layer 417 to thermally shield the magnet system from the heating element assembly 416. The insulation layer 416 may include MICROTHERM® panels commercially available from Microtherm nv, BE.

Surrounding the insulated, vacuum chamber wall 412 can optionally be a cooling jacket that includes one or more outer cylindrical tubes 418, 419 between which is an annular channel 415 for flowing a heat transfer fluid. Heat transfer fluid can be circulated through the annular channel 415 at a flow rate of about 1 to 20 liters per minute (e.g., 5-10 liters per minute), and at a temperature of about 20 degrees C. (other temperatures are acceptable). The annular channel 415 is configured for maximum heat transfer efficiency when the heating element assembly 416, or both the heating element assembly 416 and the vertical furnace 410 are running in conduction mode (i.e., during the cooling phase of the thermal/anneal cycle), and prevents the overheating of the magnet system by maintaining the exterior temperature below about 35 degrees C. The heat transfer fluid employed in the annular channel 415 may include, but is not limited to, water, a 50/50 solution of water and ethylene glycol, or any fluid that provides the requisite cooling temperature. In the event ethylene glycol is used, a cooling temperature lower than 20 degrees C. can be obtained. Forced air cooling could also be used.

Figure 6:
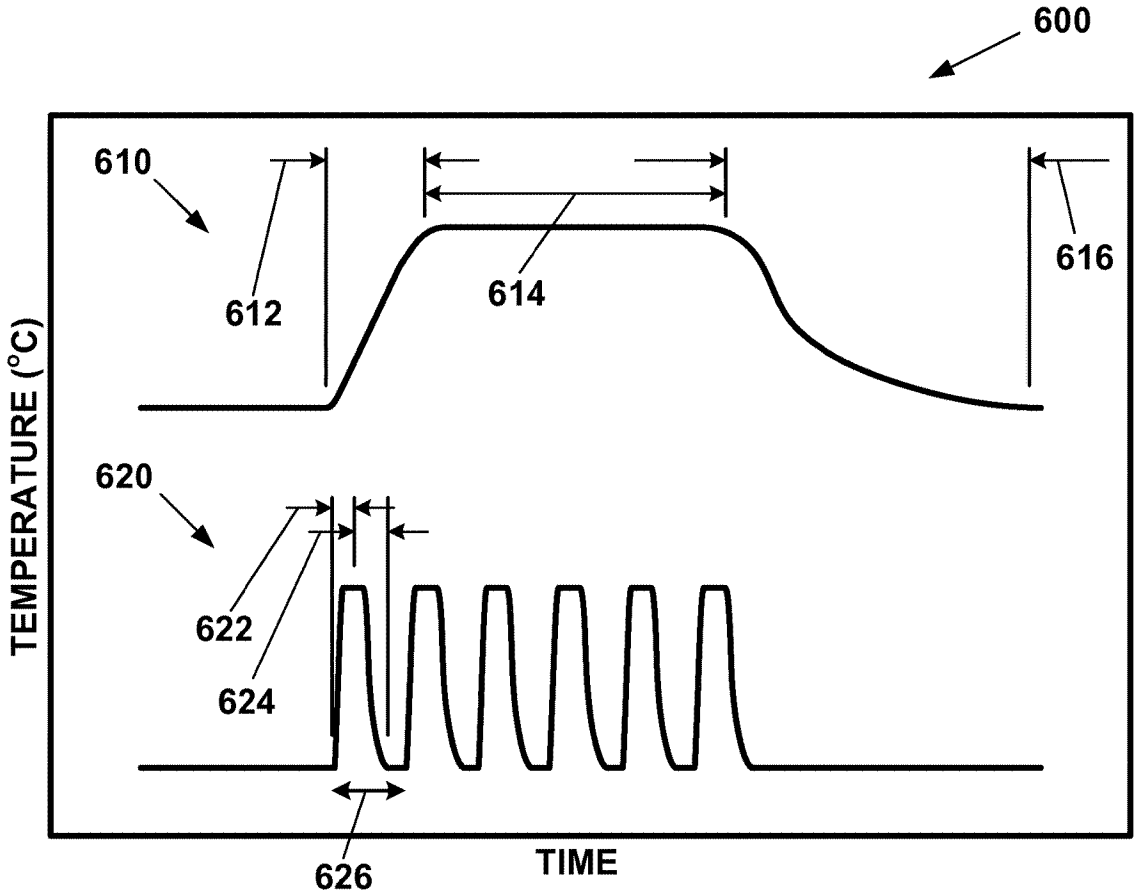
FIG. 6 provides a schematic illustration of an anneal temperature recipe according to various embodiments.

Annealing systems 1, 2, 100, 400 may be operable for magnetic and non-magnetic annealing of workpieces. The anneal process condition, including the anneal temperature recipe, is selected depending on the desired film properties of layers to be annealed on the workpiece. Referring now to FIG. 6, several anneal temperature recipes 600 are illustrated for achieving the desired result. For example, the anneal temperature recipe may include a continuous anneal sequence 610 or a pulsed anneal sequence 620.

In the continuous anneal sequence 610, the anneal temperature recipe includes ramping the temperature from ambient temperature (or a system idle or another elevated temperature) to a first anneal temperature during a first time duration 612, maintaining the first anneal temperature for a second time duration 614, and ramping down the temperature from the first anneal temperature to a reduced temperature at or above the ambient temperature during a third time duration 616. The continuous anneal sequence 610 may further include an anneal temperature recipe that additionally ramps the temperature from the first anneal temperature to a second anneal temperature during a fourth time duration, and maintains the second anneal temperature for a fifth time duration.

In the pulsed anneal sequence 620, the anneal temperature recipe includes rapidly ramping up the temperature from ambient temperature (or a system idle or another elevated temperature) to a first anneal temperature during a first time duration 622, rapidly ramping down the temperature from the first anneal temperature to a reduced temperature at or above the ambient temperature during a second time duration 624, and optionally repeating the rapidly ramping up the temperature and rapidly ramping down the temperature for one or more anneal temperature cycles 626.

In an exemplary embodiment, a method for annealing workpieces at a certain temperature so as to orient the crystals in a specific direction is contemplated. Workpieces 120, 420 are placed onto a boat for treatment within a vertical furnace in a predetermined environment. The workpieces 120, 420 are held at a predetermined temperature, while a magnetic field is optionally applied via magnet system 140. For example, the optionally imposed magnetic field may have a field strength of approximately 0.05 T to approximately 10 T, e.g., 1 T, 2 T, or 5 T. This latter step is commonly referred to as a "soaking" step.

Thereafter, steps are taken to achieve the desired cooling effect (i.e., heat transfer from the workpieces 120, 420, to the heat transfer fluid in the annular chamber 415). Cooling of workpieces 120, 420 proceeds to attain a temperature sufficiently low to allow their removal from the annealing system 100, 400. An exemplary anneal process condition associated with magnetic annealing may include a continuous anneal sequence as follows: (i) heating the workpieces 120, 420 to 300 degrees C. for about forty five minutes; (ii) soaking the workpieces 120, 420 for two hours at 300 degrees C.; and (iii) cooling the workpieces 120, 420 to about 100 degrees C. over about seventy minutes.

Figure 7:
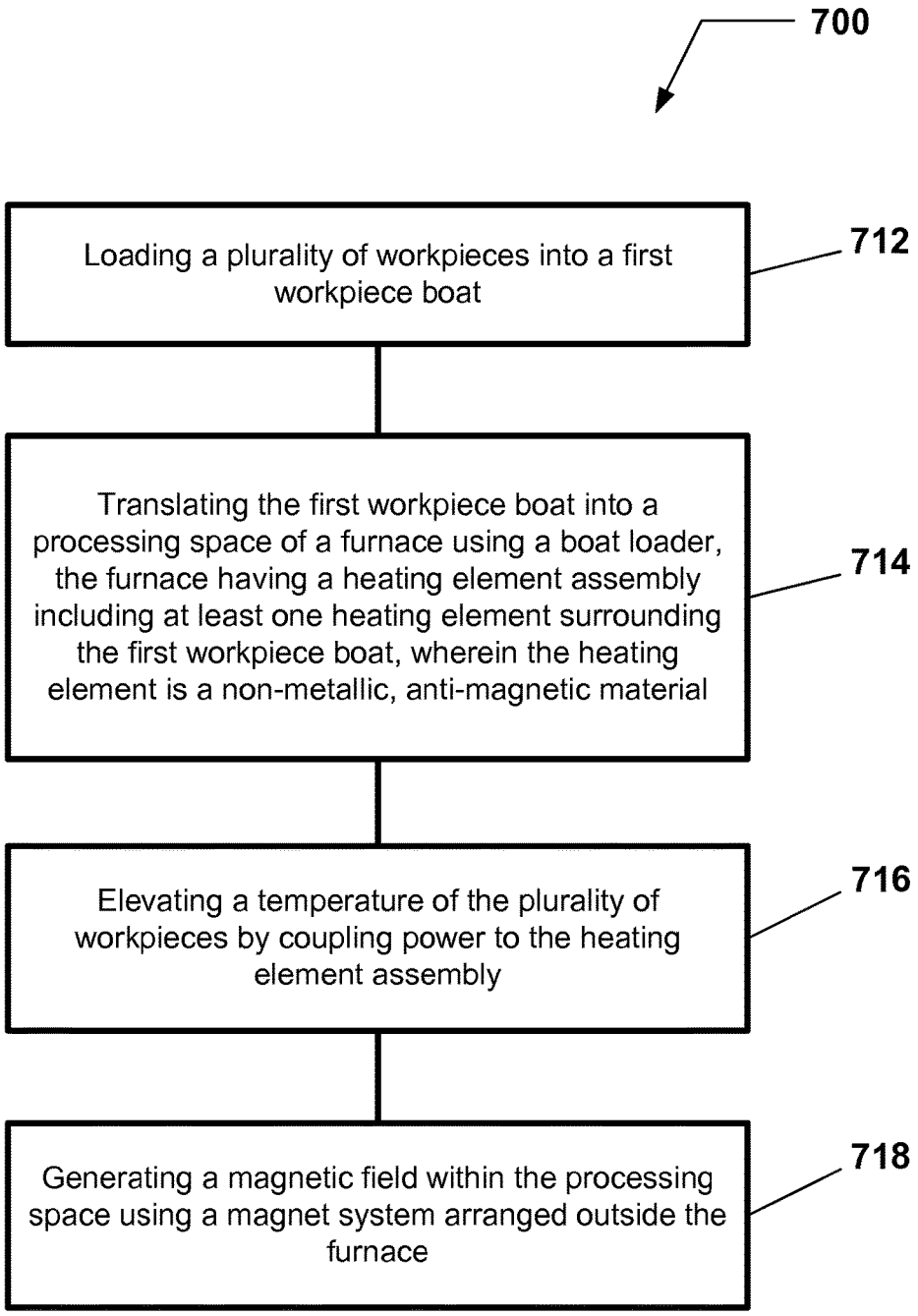
FIG. 7 provides a flow chart presenting a method of annealing a microelectronic workpiece in an annealing system according to an embodiment.

FIG. 7 illustrates a method for annealing a plurality of workpieces in an annealing system according to an embodiment. The method is illustrated in a flow chart 700, and begins in 712 with loading a plurality of workpieces into a first workpiece boat. At least one workpiece may include a multilayer stack of thin films, wherein the multilayer stack of thin films includes at least one layer containing magnetic material.

The multilayer stack may include any material suitable for fabricating a microelectronic device, such as a memory cell depending on layers containing magnetic material for either the basis of its information storage or switching of its memory state(s). These devices may include, but not be limited to, magnetoresistive random access memory (MRAM), current switching toggle magnetic structures, magnetic tunnel junction (MTJ) devices, spin torque transfer (STT) devices, spin valves, and pseudo-spin valves. Exemplary materials may include metals, such as Ru, Co, Fe, Pt, Ta, Ir, Mn, etc., and metal alloys, such as NiFe, CoFe, etc. And, these materials may be deposited using any suitable method, such as sputtering, physical vapor deposition (PVD), chemical vapor deposition (CVD), atomic layer deposition (ALD), and plasma-assisted variations thereof, for example.

In one embodiment, the multilayer stack includes one or more layers containing magnetic material. The layer containing magnetic material may include ferromagnetic and/or anti-ferromagnetic materials. As an example, a microelectronic device having a magnetic tunnel junction (MTJ) can include two electrode layers composed of a ferromagnetic material and separated by a thin tunneling barrier, such as magnesium oxide or aluminum oxide. When the magnetic moments of the two electrode layers are oriented parallel to one another, the resistance to current flow across the magnetic tunnel junction is relatively low. And conversely, when the magnetic moments of the two electrode layers are oriented antiparallel to one another, the resistance to current flow across the magnetic tunnel junction is relatively high. The resultant microelectronic device may be based on the switching of these two resistive states, the performance of which may be characterized by the MR, as described above.

In 714, the first workpiece boat is translated into a processing space of a furnace using a boat loader, wherein the furnace has at least one heating element assembly surrounding the first workpiece boat, and wherein the heating element assembly includes one or more heating elements composed of a non-metallic, anti-magnetic material. Additionally, a vacuum chamber wall defines the processing space, wherein the heating element assembly is located radially inward from the vacuum chamber wall within the processing space. The annealing system can include any one of the embodiments presented in FIGS. 1 through 5.

Thereafter, in 716, a temperature of the plurality of workpieces is elevated by coupling power to the heating element assembly.

And, in 718, a magnetic field is generated within the processing space using a magnet system arranged outside the furnace.

The method of annealing may be performed according to an anneal process condition that includes: (1) elevating a temperature of the plurality of workpieces relative to ambient temperature for an anneal time period according to an anneal temperature recipe, or (2) exposing the plurality of workpieces to a magnetic field for an anneal time period according to an anneal magnetic field recipe, or (3) performing both the elevating the temperature of the plurality of workpieces and the exposing the plurality of workpieces to a magnetic field, wherein the anneal process condition is selected to adjust a property of the layer containing magnetic material.

The anneal process condition may be selected to adjust a property of the layer containing magnetic material. The property of the layer containing magnetic material may include crystallization, uniaxial anisotropy, magnetoresistance ratio (MR), or resistance area product, or a combination of two or more thereof. As an example, the annealing may be performed to transition a composition of the layer containing magnetic material from a substantially amorphous phase to a substantially crystalline phase, and produce a desired anisotropy direction in or at the surface of the layer containing magnetic material.

According to embodiments described herein, the annealing of the layer containing magnetic material may include elevating a temperature of the layer containing magnetic material, or imposing a magnetic field on the layer containing magnetic material, or both elevating a temperature of the layer containing magnetic material and imposing a magnetic field on the layer containing magnetic material.

The anneal process condition may include setting and adjusting one or more process parameters for controlling the annealing process. The one or more process parameters may include an anneal temperature for thermally treating the plurality of workpieces when the plurality of workpieces require annealing at an elevated temperature, the anneal time period for performing the annealing process, the gaseous composition of the process environment within which the one or more workpieces are annealed, the pressure within the annealing system, the field strength of an imposed magnetic field when the one or more workpieces require annealing in a magnetic field, etc.

During annealing, the anneal temperature of the plurality of workpieces may be elevated according to an anneal temperature recipe that includes a peak temperature ranging from about 200 degrees C. to about 600 degrees C. For example, the peak temperature may range from about 250 degrees C. to about 350 degrees C. The anneal time period may range up to about 100 hours. For example, the anneal time period may range from about 1 second to about 10 hours.

Furthermore, during annealing, the plurality of workpieces may be exposed to a magnetic field according to an anneal magnetic field recipe that includes a field strength ranging up to 10 T. For example, the magnetic field may have a field strength ranging up to 2 T. The anneal time period may range up to about 100 hours. For example, the anneal time period may range from about 1 second to about 10 hours.

The method of annealing may further include the following: prior to vertically translating the first workpiece boat, indexing the first workpiece boat from a load/unload position to a process position using a workpiece boat transport system arranged beneath the vertical furnace; and loading the plurality of workpieces into a second workpiece boat, as shown in FIGS. 2 through 4.

Although only certain embodiments of this invention have been described in detail above, those skilled in the art will readily appreciate that many modifications are possible in the embodiments without materially departing from the novel teachings and advantages of this invention. Accordingly, all such modifications are intended to be included within the scope of this invention.

The invention claimed is:

1. A magnetic annealing system, comprising:

a furnace comprising a vacuum chamber wall that defines a processing space into which a plurality of workpieces may be translated and subjected to thermal and magnetic processing, the furnace further comprising a heating element assembly including at least one heating element located radially inward from the vacuum chamber wall and immersed within an outer region of the processing space, wherein the heating element is composed of a non-metallic, anti-magnetic material; and a magnet system arranged outside the vacuum chamber wall of the furnace, and configured to generate a magnetic field within the processing space.

2. The system of claim 1, wherein the heating element is composed primarily of carbon (C).

3. The system of claim 1, wherein the furnace is oriented in a horizontal configuration such that workpieces are translated horizontally into and out of the furnace, or wherein the furnace is oriented in a vertical configuration such that workpieces are translated vertically into and out of the furnace.

4. The system of claim 1, further comprising:

a workpiece boat for carrying the plurality of workpieces; and a boat loader operably configured to translate the workpiece boat and position the workpieces within the processing space.

5. The system of claim 4, wherein the system includes at least two workpiece boats each carrying a plurality of wafers, wherein the furnace is a vertical furnace, and workpiece boats are transferred vertically into and out of the vertical furnace by the boat loader, the system further comprising:

a workpiece boat turntable arranged adjacent the vertical furnace, and configured to support the at least two workpiece boats, wherein the workpiece boat turntable includes a load/unload position at which a workpiece boat is loaded onto the workpiece boat turntable prior to processing and from which a workpiece boat is unloaded from the workpiece boat turntable after processing, the workpiece boat turntable further including a process position at which the boat loader transfers a workpiece boat between the workpiece boat turntable and the vertical furnace, wherein the workpiece boat turntable is configured to rotate to index workpiece boats between the process position and the load/unload position, and wherein the workpiece boat turntable includes an opening at the process position to permit the boat loader to engage and translate workpiece boats into and out of the vertical furnace.

6. The system of claim 4, wherein the heating assembly is disposed in a vacuum during processing, and wherein the heating assembly directly faces a workpiece boat loaded in the furnace during processing without a process tube between the heating assembly and the workpiece boat.

7. The system of claim 1, wherein the heating element comprises a carbon element sheathed within a protective casing.

8. The system of claim 1, wherein the vacuum chamber wall is composed of stainless steel, and at least a portion of an inner surface of the vacuum chamber wall has a reflectance that is equal to or greater than 50%.

9. The system of claim 1, further comprising:

a controller operably coupled to the furnace and the magnet system, and programmably configured to operate a power supply coupled to the at least one heating element.

10. The system of claim 9, wherein the controller programmably operates the power supply to achieve workpiece heating rates ranging from about 10° C. per minute to about 100° C. per minute.

11. The system of claim 9, wherein the controller programmably operates the power supply to achieve workpiece cooling rates ranging from about 5° C. per minute to about 20° C. per minute.

12. The system of claim 1, wherein the magnet system includes an electromagnet or a permanent magnet.

13. The system of claim 1, wherein the magnet system includes a solenoid magnet or a Helmholtz magnet.

14. The system of claim 1, wherein the magnet system includes a superconducting magnet.

15. The system of claim 1, wherein the magnet system generates a magnetic field within the processing space having a magnetic field strength ranging up to 10 Tesla.

16. A method of operating a magnetic annealing system, comprising:

loading a plurality of workpieces into a first workpiece boat;

translating the first workpiece boat into a processing space of a furnace using a boat loader, wherein the processing space is defined within a vacuum chamber wall and the furnace comprises a heating element assembly positioned inside of the vacuum chamber wall, the heating assembly including at least one heating element surrounding the first workpiece boat, wherein the heating element is composed of a non-metallic, anti-magnetic material, and wherein after translating the first workpiece boat into the processing space the heating assembly is positioned between the workpiece boat and the vacuum chamber wall;

elevating a temperature of the plurality of workpieces by coupling power to the heating element assembly;

generating a magnetic field within the processing space using a magnet system arranged outside the furnace; and wherein the plurality of workpieces and the heating assembly are maintained in a vacuum pressure within the vacuum chamber wall during at least part of the elevating of the temperature or the generating the magnetic field.

17. The method of claim 16, wherein the heating element is composed primarily of carbon (C).

18. The method of claim 16, further comprising:

positioning the plurality of workpieces with respect to the at least one heating element such that the plurality of workpieces are in direct line-of-sight with the at least one heating element in the processing space.

19. The method of claim 16, further comprising:

heating the plurality of workpieces at a rate ranging from about 10° C. per minute to about 100° C. per minute; and cooling the plurality of workpieces at a rate ranging from about 5° C. per minute to about 20° C. per minute.

20. The system of claim 1, wherein the furnace is a vertical furnace, the system further including a boat loader for loading and unloading workpiece boats to and from the vertical furnace and workpiece boats are transferred vertically into and out of the vertical furnace by the boat loader, the system further comprising:

a workpiece boat turntable arranged below the vertical furnace, and configured to support at least two workpiece boats, wherein the workpiece boat turntable includes a load/unload position at which a workpiece boat is loaded onto the workpiece boat turntable prior to processing and from which a workpiece boat is unloaded from the workpiece boat turntable after processing, the workpiece boat turntable further including a process position at which the boat loader transfers a workpiece boat between the workpiece boat turntable and the vertical furnace, and wherein the workpiece boat turntable is configured to rotate to index workpiece boats between the process position and the load/unload position, and wherein the workpiece boat turntable includes an opening at the process position to permit the boat loader to engage and translate workpiece boats into and out of the vertical furnace.

* * * * *